US011117411B2

(12) United States Patent
Igarashi et al.

(10) Patent No.: US 11,117,411 B2
(45) Date of Patent: Sep. 14, 2021

(54) TRANSFER PAPER

(71) Applicant: MITSUBISHI PAPER MILLS LIMITED, Tokyo (JP)

(72) Inventors: Koji Igarashi, Tokyo (JP); Jun Urasaki, Tokyo (JP)

(73) Assignee: MITSUBISHI PAPER MILLS LIMITED, Tokyo (JP)

( * ) Notice: Subject to any disclaimer, the term of this patent is extended or adjusted under 35 U.S.C. 154(b) by 180 days.

(21) Appl. No.: 16/337,831

(22) PCT Filed: Jul. 3, 2017

(86) PCT No.: PCT/JP2017/024376
§ 371 (c)(1),
(2) Date: Mar. 28, 2019

(87) PCT Pub. No.: WO2018/061376
PCT Pub. Date: Apr. 5, 2018

(65) Prior Publication Data

US 2020/0039275 A1 Feb. 6, 2020

(30) Foreign Application Priority Data

| | | |
|---|---|---|
| Sep. 29, 2016 | (JP) | JP2016-191390 |
| Sep. 30, 2016 | (JP) | JP2016-192946 |
| Apr. 28, 2017 | (JP) | JP2017-089944 |
| Apr. 28, 2017 | (JP) | JP2017-089945 |

(51) Int. Cl.

| | |
|---|---|
| ***B41M 5/50*** | (2006.01) |
| ***B41M 5/52*** | (2006.01) |
| ***B41M 5/382*** | (2006.01) |
| ***D06P 1/52*** | (2006.01) |
| ***D06P 1/673*** | (2006.01) |
| ***D06P 5/28*** | (2006.01) |
| ***D06P 5/30*** | (2006.01) |
| ***D21H 19/38*** | (2006.01) |
| ***D21H 19/58*** | (2006.01) |
| ***D21H 21/52*** | (2006.01) |

(52) U.S. Cl.
CPC ..... *B41M 5/5218* (2013.01); *B41M 5/38214* (2013.01); *B41M 5/5245* (2013.01); *B41M 5/5254* (2013.01); *D06P 1/5257* (2013.01); *D06P 1/67341* (2013.01); *D06P 5/005* (2013.01); *D06P 5/30* (2013.01); *D21H 19/385* (2013.01); *D21H 19/58* (2013.01); *D21H 21/52* (2013.01); *Y10T 428/24802* (2015.01); *Y10T 428/24893* (2015.01)

(58) Field of Classification Search
CPC ..... B41M 5/5218; B41M 5/5254; Y10T 428/24802; Y10T 428/24893
USPC ..... 428/32.34
See application file for complete search history.

(56) References Cited

U.S. PATENT DOCUMENTS

| | | | | |
|---|---|---|---|---|
| 6,902,779 | B1 | 6/2005 | de Visser et al. | |
| 2002/0144797 | A1* | 10/2002 | Skuse | D21H 17/375 162/181.1 |
| 2003/0064208 | A1* | 4/2003 | Yamada | B41M 5/52 428/195.1 |
| 2005/0186363 | A1 | 8/2005 | de Visser et al. | |
| 2008/0063818 | A1 | 3/2008 | de Visser et al. | |
| 2009/0022912 | A1* | 1/2009 | Kaessberger | B41M 5/5218 428/32.34 |
| 2012/0160119 | A1 | 6/2012 | Martinovic | |
| 2018/0264864 | A1 | 9/2018 | Dentani et al. | |

FOREIGN PATENT DOCUMENTS

| | | | | |
|---|---|---|---|---|
| CN | 102448731 | A | 5/2012 | |
| EP | 0 805 049 | A1 | 11/1997 | |
| JP | 2002-521245 | A | 7/2002 | |
| JP | 2002292995 | * | 10/2002 | B41M 5/00 |
| JP | 2009-131958 | A | 6/2009 | |
| JP | 2009-291968 | A | 12/2009 | |
| JP | 2010-082839 | A | 4/2010 | |
| JP | 2010-158875 | A | 7/2010 | |
| JP | 2015-124324 | A | 7/2015 | |
| JP | 2015-168705 | A | 9/2015 | |
| JP | 2016-159483 | A | 9/2016 | |
| WO | WO 2016/136122 | A1 | 9/2016 | |

OTHER PUBLICATIONS

Gurley Precision Instruments—Wikipedia (Year: 2019).*
Extended European Search Report issued in corresponding European Application No. 17855335.0 dated Feb. 19, 2020.
Chinese Office Action and Search Report for Chinese Application No. 201780050277.7, dated Dec. 24, 2020, with English translation.

* cited by examiner

*Primary Examiner* — Betelhem Shewareged
(74) *Attorney, Agent, or Firm* — Birch, Stewart, Kolasch & Birch, LLP

(57) ABSTRACT

A transfer paper used for a transfer printing method using sublimation textile ink, comprising a base paper and one or more coating layer(s) provided on at least one side of the base paper, wherein an outermost coating layer positioned on the outermost side with respect to the base paper contains at least a pigment, a binder, a polyacrylic acid salt and an acetylene glycol derivative, has image deterioration resistance, good color development property and excellent adhesion property.

12 Claims, No Drawings

TRANSFER PAPER

TECHNICAL FIELD

The present invention relates to a transfer paper used for transferring an pattern in a transfer printing method for forming a pattern on a printing substrate such as a textile material.

BACKGROUND ART

As a method for forming a pattern on a printing substrate such as a textile material, a transfer printing method is known in which an pattern is printed on a transfer paper using sublimation textile ink to prepare a printed transfer paper, and the printed transfer paper is brought into close contact with the printing substrate to transfer the sublimation textile ink onto the printing substrate (see, for example, Patent Document 1 and Patent Document 2).

Transfer paper used for transfer printing method is known.

For example, a sublimation transfer sheet comprising a sheet type base material, and an ink accepting layer provided on one side or both sides of the sheet type base material, wherein the ink accepting layer contains a pigment, a binder, and a cationic resin, and as the pigment, precipitated silica is used, and as the binder, any one of starch, starch derivative, polyvinyl alcohol and modified polyvinyl alcohol, or a mixture of two or more thereof is used, is known as a sublimation transfer sheet excellent in absorption property of aqueous ink and capable of obtaining a clear recorded image free from bleeding, and also excellent in ink transfer efficiency to a transferring object upon sublimation transfer (see, for example, Patent Document 3).

In addition, for a sublimation textile transfer paper having excellent ink drying property and strike-through suppression property and having good characteristics in terms of image reproducibility by transfer and transfer efficiency, known is a sublimation printing transfer paper having a sublimation textile ink receiving layer on a substrate, wherein the sublimation textile ink receiving layer comprises a water soluble resin and fine particles dispersed as main components and a nonionic surfactant, and the surface of the sublimation textile ink receiving layer has irregularities (see, for example, Patent Document 4).

For a sublimation inkjet textile transfer paper excellent in absorption/drying property of sublimation textile ink at the time of inkjet printing, having excellent image reproducibility and strike-through suppression property, and also excellent in transfer efficiency at the time of transfer printing to a transferred object, known is a sublimation inkjet textile transfer paper comprising a substrate and a sublimation textile ink receiving layer formed on the substrate, wherein the substrate has a 10 seconds Cobb water absorption degree of 5 to 20 g/m$^2$, the sublimation textile ink receiving layer comprises an ink receiving layer paint containing a water soluble resin and fine particles, the water soluble resin is at least carboxymethylcellulose, and the carboxymethyl cellulose is contained in the ink receiving layer paint in an amount of 100 to 400 parts by mass based on 100 parts by mass of the fine particles, the fine particles are inorganic fine particles having at least a tabular crystal structure, the inorganic fine particles have a median diameter d50 of 0.4 to 2.3 μm and an aspect ratio of 5 to 30, the coated amount of the ink receiving layer paint is 3 to 13 g/m$^2$, and the average of the pinhole expression number is 5 or less (see, for example, Patent Document 5).

A transfer paper suitable for inkjet printing is also known which has a release or barrier layer and has a porosity of up to 100 ml/min (see, for example, Patent Document 6).

As a method for printing a pattern on a transfer paper using an ink containing a sublimation dye or a sublimation textile ink to prepare a printed transfer paper, an inkjet printing method is often used as described in Patent Documents 3 to 6.

PRIOR ART DOCUMENTS

Patent Documents

Patent Document 1: Japanese Patent Application Kokai Publication No. 2015-168705 (unexamined, published Japanese patent application)

Patent Document 2: Japanese Patent Application Kokai Publication No. 2015-124324 (unexamined, published Japanese patent application)

Patent Document 3: Japanese Patent Application Kokai Publication No. 2010-158875 (unexamined, published Japanese patent application)

Patent Document 4: Japanese Patent Application Kokai Publication No. 2009-131958 (unexamined, published Japanese patent application)

Patent Document 5: Japanese Patent Application Kokai Publication No. 2016-159483 (unexamined, published Japanese patent application)

Patent Document 6: Japanese Patent Application Kohyo Publication No. 2002-521245 (unexamined, published Japanese patent application)

SUMMARY OF THE INVENTION

Problems to be Solved by the Invention

It is necessary to have two contradictory characteristics between a transfer paper which is a blank paper before a pattern is printed and a printed transfer paper which is obtained by printing a pattern on the transfer paper. That is, the transfer paper is required to have an ability to successfully receive a sublimation textile ink, while the printed transfer paper is required to have an ability to successfully transfer the sublimation textile ink to a printing substrate.

It is necessary for a transfer paper to improve its receptivity to a sublimation textile ink in order to become a printed transfer paper having a sharp image so as not to deteriorate the image quality of a pattern formed on a printing substrate. Furthermore, it is necessary for a transfer paper not to deteriorate the image quality of a pattern formed on a printing substrate from the printed transfer paper having a sharp image.

On the other hand, if the receptivity of the transfer paper to the sublimation textile ink is improved, there is a case that transfer of the sublimation textile ink becomes insufficient at the time of transferring for forming a pattern on the printing substrate by the printed transfer paper. As a result, reduction in color development property occurs in the printing substrate.

In order to carry out transfer by bringing a printed transfer paper and a printing substrate into close contact with each other, the printed transfer paper must be able to adhere well to the printing substrate. Apart from deterioration of image quality at the time of image formation as described above, there is a problem of image quality which occurs due to poor adhesion between the printed transfer paper and the printing substrate. Out-of-focus or distortion of an image occurs in a region where the printed transfer paper and the printing substrate are not in close contact with each other.

In the case of continuously transferring to a printing substrate, a printed transfer paper in the form of roll paper is brought into close contact with the printing substrate to carry out transfer. In particular, in order to continuously carry out transfer, it is more important that the printed transfer paper adheres well to the printing substrate.

Further, in a transfer printing method, there is fog as a problem of image quality which is different from deterioration of the image quality of a pattern formed on a printing substrate. Fog is a phenomenon in which sublimation textile ink sublimates and transfers to a region different from a pattern when sublimation textile ink is transferred from a printed transfer paper to a printing substrate. Typically, it is a phenomenon that spot stains are generated on a white background. Although a method of suppressing fog by means of sublimation textile ink technique has been studied, a method of suppressing fog by a transfer paper is also required.

Also, in order to successfully transfer a sublimation textile ink from a printed transfer paper to a printing substrate, a transfer paper must receive the sublimation textile ink without penetrating to the deep portion of the paper. That is, a transfer paper is required to have strike-through suppression property. "Strike-through" is a phenomenon in which a sublimation textile ink of an image printed on a transfer paper penetrates deep into the paper.

In many cases, an inkjet printing method is adopted as a method of printing a pattern on a transfer paper to produce a printed transfer paper. In the inkjet printing system, a transfer paper and a printed transfer paper are often handled in the form of roll paper, and evaporation of ink solvent tends to be delayed in the roll paper state. There is a demand for a transfer paper which can absorb sublimation textile ink so that the sublimation textile ink does not bleed during the time until the ink solvent evaporates in the printed transfer paper wound into a roll after printing.

The qualities of the sublimation transfer sheet of Patent Document 3, the sublimation inkjet textile printed transfer paper of Patent Document 4, the sublimation inkjet textile printed transfer paper of Patent Document 5, and the sublimation inkjet textile printed transfer paper of Patent Document 6 are not necessarily sufficient, and in particular, it is desired to improve with respect to the fact that a printed transfer paper adheres well to a printing substrate or fog is suppressed.

In view of the above, an object of the present invention is to provide a transfer paper satisfying the following items.

(1) Deterioration of an image in a printing substrate can be suppressed (image deterioration resistance).

(2) Reduction of color development in a printing substrate can be suppressed (color development property)

(3) A printed transfer paper and a printing substrate are well adhered (adhesion property)

It is a further object of the present invention to provide a transfer paper satisfying the following items in a preferred embodiment.

(4) Fog can be suppressed from occurring in a printing substrate (fog resistance)

(5) Strike-through can be suppressed in a printed transfer paper (strike-through suppression property)

(6) Ink can be absorbed so as not to bleed in a printed transfer paper (ink absorption property)

Means for Solving the Problems

As a result of extensive studies to solve the above problems, the present inventors have accomplished the object of the present invention by the following.

[1] A transfer paper used for a transfer printing method using sublimation textile ink, comprising a base paper and one or more coating layer(s) provided on at least one side of the base paper, wherein an outermost coating layer positioned on the outermost side with respect to the base paper contains at least a pigment, a binder, a polyacrylic acid salt and an acetylene glycol derivative.

According to this, the transfer paper can obtain image deterioration resistance, color development property and adhesion property.

[2] The transfer paper according to [1], wherein, in the outermost coating layer, a content of the polyacrylic acid salt is 0.1 parts by mass or more and 3.5 parts by mass or less based on 100 parts by mass of the binder.

According to this, the transfer paper has improved color development property or adhesion property.

[3] The transfer paper according to [1] or [2], wherein the polyacrylic acid salt is ammonium polyacrylate.

According to this, the transfer paper has improved image deterioration resistance.

[4] The transfer paper according to [3], wherein a weight average molecular weight of the ammonium polyacrylate measured by gel permeation chromatography method is 5,000 or more and 30,000 or less.

According to this, mainly, the transfer paper has improved adhesion property.

[5] The transfer paper according to any one of [1] to [4], wherein at least one of the pigment in the outermost coating layer is precipitated calcium carbonate having an average secondary particle diameter of 2 μm or more and 6 μm or less in which primary particles having an average long diameter/average short diameter ratio of 2.0 or more and 7.0 or less are radially aggregated at one end in the long diameter direction, and a content of the precipitated calcium carbonate is 80 parts by mass or more based on 100 parts by mass of the pigment in the outermost coating layer.

According to this, the transfer paper is capable of obtaining image deterioration resistance, fog resistance, strike-through suppression property and ink absorption property.

[6] The transfer paper according to [5], wherein an air permeability obtained by measuring the side provided with the outermost coating layer according to ISO 5636-3 is more than 100 ml/min and 320 ml/min or less.

According to this, the transfer paper has improved strike-through suppression property or fog resistance.

Effects of the Invention

According to the present invention, it is possible to provide a transfer paper excellent in image deterioration resistance, color development property and adhesion property. Further, in a preferred embodiment, it is possible to provide a transfer paper having fog resistance, strike-through suppression property and ink absorption property.

MODE FOR CARRYING OUT THE INVENTION

The present invention will be described below in detail.

In the present invention, the term "transfer paper" means a paper in a blank state before a pattern to be transferred is printed. The term "printed transfer paper" means a paper on which a pattern to be transferred to a printing substrate has been printed.

The transfer paper has a base paper and one or more coating layer(s) provided on at least one side of the base paper. In the case where the coating layer is one layer, the coating layer corresponds to the outermost coating layer, and the outermost coating layer contains at least a pigment, a binder, a polyacrylic acid salt and an acetylene glycol derivative. In the case of two or more coating layers, the outermost coating layer positioned on the outermost side with respect to the base paper contains at least a pigment, a binder, a polyacrylic acid salt and an acetylene glycol derivative. In the case of two or more coating layers, an intermediate coating layer existing between the base paper and the outermost coating layer may be either a coating layer containing a pigment and a binder or a coating layer without containing a pigment. When the intermediate coating layer has a pigment, its particle size and shape are not particularly limited. Furthermore, the presence or absence of a polyacrylic acid salt or an acetylene glycol in the intermediate coating layer is not particularly limited.

From the viewpoint of production cost, the coating layer is preferably one layer. The coating layer may be provided on one side or both sides of the base paper. When the outermost coating layer according to the present invention is provided on one side of the base paper, the transfer paper may have a conventionally known back coat layer on the back face of the base paper.

The coating amount of the coating layer is not particularly limited. From the viewpoint of the production cost of a transfer paper and easy adhesion to a printing substrate, the coating amount is preferably 2 $g/m^2$ or more and 70 $g/m^2$ or less in terms of dry solid content per one side. The upper limit of the coating amount is more preferably 30 $g/m^2$ or less, still more preferably 20 $g/m^2$ or less. Furthermore, the coating amount is most preferably 2 $g/m^2$ or more and 12 $g/m^2$ or less per side, because the production cost can be reduced and it is possible to prevent the coating layer of the transfer paper from being missing when adhering to a printing substrate. When there are a plurality of coating layers per one side, the coating amount is the total value thereof.

The base paper is a papermaking paper obtained by making a paper stock containing at least one pulp selected from chemical pulp such as LBKP (Leaf Bleached Kraft Pulp) and NBKP (Needle Bleached Kraft Pulp), mechanical pulp such as GP (Groundwood Pulp), PGW (Pressure Ground Wood pulp), RMP (Refiner Mechanical Pulp), TMP (Thermo Mechanical Pulp), CTMP (ChemiThermoMechanical Pulp), CMP (Chemi Mechanical Pulp) and CGP (Chemi Groundwood Pulp), and waste paper pulp such as DIP (DeInked Pulp), various fillers such as calcium carbonate, talc, clay and kaolin, and various additives such as a sizing agent, a fixing agent, a retention aid, a cationizing agent and a paper strengthening agent as required into a paper. Further, the base paper includes woodfree paper which is subjected to calendering processing, surface sizing with starch, polyvinyl alcohol or the like, or surface treatment or the like on a papermaking paper. Further, the base paper includes woodfree paper which has been subjected to calendering processing after subjected to surface sizing or surface treatment.

Paper making is carried out by adjusting a paper stock to acidic, neutral or alkaline and using a conventionally known papermaking machine. Examples of a papermaking machine include a fourdrinier papermaking machine, a twin wire papermaking machine, a combination papermaking machine, a cylindrical papermaking machine, a yankee papermaking machine and the like.

The basis weight of the base paper is not particularly limited. From the viewpoint of ease of handling for transfer to a printing substrate, the basis weight of the base paper is preferably 10 $g/m^2$ or more and 100 $g/m^2$ or less, more preferably 30 $g/m^2$ or more and 90 $g/m^2$ or less. Further, the thickness of the transfer paper is not particularly limited. The thickness of the transfer paper is preferably 0.01 mm or more and 0.5 mm or less, and more preferably 0.05 mm or more and 0.3 mm or less from the viewpoint of ease of handling for transfer to a printing substrate.

In the paper stock, one or two or more of other additives selected from a pigment dispersant, a thickener, a fluidity improving agent, a defoamer, an antifoamer, a releasing agent, a foaming agent, a penetrating agent, a colored dye, a colored pigment, an optical brightener, an ultraviolet light absorber, an antioxidant, a preservative, a fungicide, an insolubilizer, an wet paper strengthening agent, a dry paper strengthening agent can be blended appropriately as long as the desired effect of the present invention is not impaired.

The transfer paper has one or more coating layer(s) on at least one side of the base paper. The coating layer can be provided on the base paper by coating and drying each coating layer-coating composition on the base paper.

The method of providing a coating layer on a base paper is not particularly limited. For example, a coating method and a drying method using a coating apparatus and a drying apparatus conventionally known in the field of papermaking can be mentioned. Examples of the coating apparatus may include a size press, a gate roll coater, a film transfer coater, a blade coater, a rod coater, an air knife coater, a comma coater, a gravure coater, a bar coater, an E bar coater, a curtain coater, and the like. Examples of the drying apparatus may include various drying apparatuses including a hot air dryer such as a straight tunnel dryer, an arch dryer, an air loop dryer and a sine curve air float dryer, an infrared heating dryer, a dryer using microwave, and the like.

The outermost coating layer contains at least a pigment, a binder, a polyacrylic acid salt and an acetylene glycol derivative.

In the outermost coating layer, the content ratio by mass of the pigment and the binder is preferably pigment: binder=20:80 to 80:20. When the specific surface area of the pigment is relatively large, pigment:binder is preferably 20:80 to 40:60, and when the specific surface area of the pigment is relatively small, pigment:binder is preferably 50:50 to 80:20. Here, when the BET specific surface area is 150 $m^2/g$ or less, the specific surface area of the pigment is relatively small, and when the BET specific surface area exceeds 150 $m^2/g$, the specific surface area of the pigment is relatively large.

The content of the polyacrylic acid salt in the outermost coating layer is preferably 0.05 parts by mass or more and 1.2 parts by mass or less, more preferably 0.1 parts by mass or more and 1 part by mass or less based on 100 parts by mass of the total of the pigment and the binder. In the outermost coating layer, the content of the polyacrylic acid salt is preferably 0.1 parts by mass or more and 3.5 parts by mass or less based on 100 parts by mass of the binder.

The content of the acetylene glycol derivative in the outermost coating layer is preferably 0.1 parts by mass or more and 0.5 parts by mass or less based on 100 parts by mass of the total of the pigment and the binder.

In the present invention, the content of the polyacrylic acid salt according to the present invention is not included in the content of the binder.

The pigment in the outermost coating layer is a pigment conventionally known in the field of coated paper and is not particularly limited. The pigment is preferably a white pigment, and examples of the white pigment may include inorganic pigments such as kaolin, ground calcium carbonate, precipitate calcium carbonate, talc, satin white, lithopone, titanium oxide, zinc oxide, silica, alumina, aluminum hydroxide, activated clay, diatomaceous earth, and organic pigments such as plastic pigments. The outermost coating layer contains one or two or more selected from these pigments.

For a pigment having a relatively small specific surface area, kaolin and precipitated calcium carbonate are preferred. For a pigment having a relatively large specific surface area, silica is preferred.

At least one of the pigment in the outermost coating layer is preferably precipitated calcium carbonate having an average secondary particle diameter of 2 μm or more and 6 μm or less in which primary particles having an average long diameter/average short diameter of 2.0 or more and 7.0 or less are aggregated radially at one end in the long diameter direction.

Primary particles having an average long diameter/average short diameter of 2.0 or more and 7.0 or less have an elongated shape and are generally called columnar, needle-shaped or spindle-shaped particles. The secondary particles are aggregates in which such primary particles are radially aggregated at one end in the long diameter direction. The precipitated calcium carbonate having an average secondary particle diameter of 2 μm or more and 6 μm or less in which primary particles having an average long diameter/average short diameter of 2.0 or more and 7.0 or less are aggregated radially at one end in the long diameter direction is called burr-shaped precipitated calcium carbonate or echinus-shaped precipitated calcium carbonate or bur-shaped precipitated calcium carbonate (hereinafter also referred to as "burr-shaped precipitated calcium carbonate"). For example, it is precipitated calcium carbonate having a shape shown in JP S59-94700 A and JP 2015-117437 A.

As an example of a method for producing precipitated calcium carbonate, a carbon dioxide gas method, or a soluble salt reaction method, or the like can be mentioned. The carbon dioxide gas method is a method of dissolving quicklime obtained by calcining limestone in water to make lime milk and reacting carbon dioxide with the lime milk to produce precipitated calcium carbonate. The soluble salt reaction method is a method in which lime milk is reacted with calcium chloride solution and sodium carbonate to produce precipitated calcium carbonate. The crystal system, size and shape of precipitated calcium carbonate can be adjusted according to reaction conditions and the like. As a crystal system of precipitated calcium carbonate, there are calcite type crystals or aragonite type crystals or the like. The shape of the calcite type crystal is usually a spindle shape, a shape in which spindle-shaped particles are aggregated and bonded, or a cubic shape (including a dumpling shape with inconspicuous corners) or a shape in which cubic-shaped particles are aggregated and bonded. The shape of the aragonite type crystal is usually a columnar shape or a needle shape, or a shape in which the formers are aggregated. These precipitated calcium carbonate are commercially available, for example, from SHIRAISHI CALCIUM KAISHA, LTD., OKUTAMA KOGYO CO., LTD., and the like.

Aragonite type crystals are preferable for burr-shaped precipitated calcium carbonate. The reason for this is that the ink absorption property or fog resistance is improved.

The content of the burr-shaped precipitated calcium carbonate having an average secondary particle diameter of 2 μm or more and 6 μm or less in which primary particles having an average long diameter/average short diameter of 2.0 or more and 7.0 or less are radially aggregated at one end in the long diameter direction in the outermost coating layer is preferably 80 parts by mass or more based on 100 parts by mass of the pigment in the outermost coating layer. The content is preferably 85 parts by mass or more, more preferably 90 parts by mass or more, based on 100 parts by mass of the pigment in the outermost coating layer. The reason for this is that the fog resistance, the strike-through suppression property or the ink absorption property is improved.

The average short diameter and average long diameter of the primary particles of precipitated calcium carbonate, and the shape and the average secondary particle diameter of the secondary particles can be obtained by image analysis from a scanning electron micrograph of the outermost coating layer. The average short diameter and average long diameter of the primary particles can be calculated by taking an electron microscope photograph using a scanning electron microscope and observing and measuring arbitrary 100 primary particles whose shape can be confirmed from the photographed image. The average secondary particle diameter can be obtained by taking an electron microscopic photograph using a scanning electron microscope, and calculating a particle diameter regarding any arbitrary 100 secondary particles as a spherical shape approximating the projected area of the particle from the photographed image, to calculate the average secondary particle diameter.

The binder in the outermost coating layer is a conventionally known binder and is not particularly limited. However, in the present invention, the polyacrylic acid salt is excluded from the conventionally known binder. Examples of the conventionally known binder may include starch and various modified starches, cellulose derivatives such as carboxymethyl cellulose and hydroxyethyl cellulose, natural polymer resin such as casein, gelatin, soybean protein, pullulan, gum arabic, karaya gum and albumin or a derivative thereof, polyvinyl pyrrolidone, polyvinyl alcohol and various modified polyvinyl alcohols, polyacrylamide, polyethylene imine, polypropylene glycol, polyethylene glycol, maleic anhydride resin, acrylic resin, methacrylate-butadiene copolymer, a styrene-butadiene copolymer, an ethylene-vinyl acetate copolymer, or a functional group-modified copolymers of these various copolymers with monomers containing a functional group such as carboxy group, a binder such as a thermosetting synthetic resin such as a melamine resin and an urea resin, polyurethane resins, unsaturated polyester resins, polyvinyl butyral, alkyd resins latex, and the like. The outermost coating layer can contain one or two or more of these binders.

The polyacrylic acid salt in the outermost coating layer contains one or two or more structural units derived from an acrylic acid salt represented by the following general formula, and is a homopolymer or a copolymer, or a copolymer containing other structural units, if necessary. The polyacrylic acid salt of the present invention is preferably a polymer in which the structural unit derived from the acrylic acid salt represented by the following general formula accounts for 50 mol % or more of the whole.

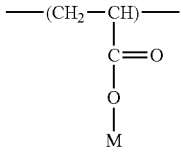

In the above general formula, M is Na, K or $NH_4$.

The polyacrylic acid salt is preferably ammonium polyacrylate. This is because the image deterioration resistance is particularly improved.

The weight average molecular weight of ammonium polyacrylate measured by a gel permeation chromatography method is preferably 1,500 or more and 50,000 or less, more preferably 5,000 or more and 30,000 or less. The reason for this is that adhesion property is improved. Ammonium polyacrylate having the weight average molecular weight of 1,500 or more and 50,000 or less is excellent as a protective colloid for pigment, so that flexibility of the outermost coating layer is increased. As a result, adhesion property is considered to be improved. It is considered that if the weight average molecular weight is less than 1,500, it becomes insufficient as a protective colloid, and if it exceeds 50,000, it is difficult to obtain flexibility.

The weight average molecular weight used in the present invention is a value in terms of polyethylene glycol of a gel permeation chromatography method.

The acetylene glycol derivative in the outermost coating layer is a compound represented by the following general formula (1) or (2).

General formula (1)

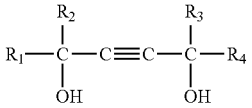

In the general formula (1), $R_1$, $R_2$, $R_3$ and $R_4$ each represent an alkyl group having 1 to 5 carbon atoms. $R_1$, $R_2$, $R_3$ and $R_4$ are preferably symmetrical with respect to the acetylene group.

General formula (2)

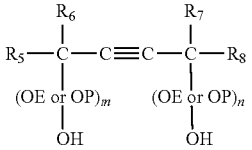

In the general formula (2), $R_5$, $R_6$, $R_7$ and $R_8$ each represent an alkyl group having 1 to 5 carbon atoms. m and n are each an integer of 1 or more and 25 or less, and m+n is 2 or more and 40 or less. OE is an oxyethylene chain (—O—$CH_2$—$C_2$—), and OP is an oxypropylene chain (—O—$CH_2$—CH[$CH_3$]—). Each of OE and OP may be a single chain or a mixed chain. $R_5$, $R_6$, $R_7$ and $R_8$ are preferably symmetrical with respect to the acetylene group.

The acetylene glycol derivative is sold under the name "Surfynol®" or "Olfine®" by Nissin Chemical Industry Co., Ltd., and under the name "Acetylenol®" by Kawaken Fine Chemicals Co., Ltd.

In the present invention, the acetylene glycol derivative is preferably 2,4,7,9-tetramethyl-5-decyne-4,7-diol or ethoxylate of 2,4,7,9-tetramethyl-5-decyne-4,7-diol. The reason for this is that it is easy to obtain commercially.

In addition to the polyacrylic acid salt and the acetylene glycol derivative, the outermost coating layer may contain various additives conventionally known in the field of coated paper, if necessary. Examples of the additives may include a dispersant, a fixing agent, a thickener, a fluidity improving agent, a defoamer, a releasing agent, a foaming agent, a penetrating agent, a colored pigment, a colored dye, an optical brightener, an antioxidant, a preservative, fungicide and the like.

Further, the outermost coating layer can contain various auxiliaries conventionally known in a transfer printing method. For example, the auxiliaries are added to optimize various physical properties of the outermost coating layer-coating composition or to improve the dyeability of the sublimation textile ink to be transferred. Examples of the auxiliaries may include various surfactants, humectants, wetting agents, pH adjusting agents, alkaline agents, color-deepning agents, deaerators, reducing inhibitors and the like.

The transfer paper of the present invention preferably has an air permeability of more than 100 ml/min and 320 ml/min or less, which is obtained by measuring the side provided with the outermost coating layer according to ISO 5636-3.

Generally, the air permeability of the base paper is a very high value as compared with the air permeability of the coated paper provided with the coating layer on the base paper. The reason for this is that the components of the coating layer block the voids of the pulp fibers constituting the base paper. Therefore, usually the air permeability of the coated paper can be adjusted by the coating layer.

The air permeability of the coated paper is a known physical property value in the field of coated paper, and can be adjusted by the size and shape of a pigment in the coating layer, the content of a pigment, the kind and content of a binder, and the like. A particularly effective adjustment method is a method of adjusting depending on the coating amount of the coating layer, presence or absence of calendering processing, and conditions thereof. By controlling calender conditions such as calender roll temperature, calender nip pressure, and calender nip time, the intended air permeability can be obtained.

In the transfer paper of the present invention, the air permeability can be adjusted similarly to the above-mentioned general coated paper.

A printed transfer paper can be obtained by printing a pattern on the side having the outermost coating layer of the transfer paper using various conventionally known printing methods using sublimation textile ink.

Various printing methods for printing a pattern on a transfer paper are conventionally known printing methods, and are not particularly limited. Examples of the printing method may include a gravure printing method, an inkjet printing method, an electrophotographic printing method, a screen printing method, and the like. Among them, an inkjet printing method is preferable from the viewpoints of high definition of image quality and downsizing of the apparatus.

The transfer printing method using sublimation textile ink is a method having a step of printing a pattern on a transfer paper to obtain a printed transfer paper and a step of bringing the printed transfer paper into close contact with a printing substrate. The step of bringing into close contact includes heating and pressurizing as necessary. Conditions of heating and pressurizing in the step of bringing into close contact are conventionally known conditions in a transfer printing method. As the step of bringing into close contact, for example, there can be mentioned a method of bringing a printed transfer paper into close contact with a printing substrate by a pressing machine, a heating drum or the like, and heating and pressurizing.

The printing substrate is a textile material, and is not particularly limited. The textile material may be either a natural fiber material or a synthetic fiber material. Examples of the natural fiber material may include cellulosic fiber materials such as cotton, hemp, lyocell, rayon and acetate, and protein fiber materials such as silk, wool and animal hair. Examples of the synthetic fiber material may include polyamide fiber (nylon), vinylon, polyester, polyacrylic and the like. As a configuration of the textile material, there can be mentioned single, blended, mixed fiber or interwoven fabric such as woven fabric, knitted fabric and nonwoven fabric. Furthermore, these configurations may be combined. If necessary, the printing substrate may be pretreated with a chemical or the like effective for promoting dyeing.

In the transfer printing method using a sublimation textile ink, the printing substrate to is preferably a synthetic fiber material. Pretreatment is often required for natural fiber materials.

EXAMPLES

Hereinafter, the present invention will be described in more detail by examples. It should be noted that the present invention is not limited to these examples. Here, "part by mass" and "% by mass" each represent "parts by mass" and "% by mass" of a dry solid content or a substantial component amount. A coating amount of a coating layer represents a dry solid content.

<Base Paper>

10 parts by mass of calcium carbonate as a filler, 1.2 parts by mass of amphoteric starch, 0.8 part by mass of aluminum sulfate, and 0.1 parts by mass of alkyl ketene dimer type sizing agent were added to a pulp slurry comprising 100 parts by mass of LBKP having a freeness degree of 380 ml csf to form a paper stock, and the paper stock was made into a papermaking paper by a fourdrinier papermaking machine. 1.5 g/m$^2$ of oxidized starch per one side was adhered on both sides of the papermaking paper with a size press machine, and then machine calendering processing was carried out to prepare a base paper having a basis weight of 62 g/m$^2$.

<Outermost Coating Layer-Coating Composition>

The outermost coating layer-coating composition was prepared by mixing and dispersing in water using the materials shown in Table 1.

The amount of each material contained in the outermost coating layer-coating composition is also shown in Table 1.

In Table 1, silica A is NIPGEL® AY-200 manufactured by TOSOH SILICA CORPORATION. Silica B is MIZUKASIL® P-527 manufactured by MIZUSAWA INDUSTRIAL CHEMICALS, LTD. Precipitated calcium carbonate is TamaPearl® TP221F (calcite type crystal, average long diameter/average short diameter=2.0, non-formation of secondary particle) manufactured by OKUTAMA KOGYO CO., LTD. Acetylene glycol derivative A is Surfynol 104E (the structure of the general formula (1)) manufactured by Nissin Chemical Industry Co., Ltd. Acetylene glycol derivative B is Olfine E1010 (structure of the general formula (2)) manufactured by Nissin Chemical Industry CO., Ltd. Acetylene alcohol is Olfine B manufactured by Nissin Chemical Industry Co., Ltd. Except for Examples 24 and 25, ammonium polyacrylate having a weight average molecular weight of about 22,000 as measured by gel permeation chromatography method was used. Ammonium polyacrylate used in Examples 24 and 25 is the one having a weight average molecular weight of about 6,000 as measured by gel permeation chromatography method.

<Transfer Paper>

A transfer paper was prepared by the following procedure.

On the base paper, the outermost coating layer-coating composition was coated on one side with an air knife coater, and dried in a hot air dryer. After that, it was subjected to calendering processing to obtain a transfer paper. The coated amount was shown in Table 1.

TABLE 1

| Materials | Example 1 | Example 2 | Example 3 | Example 4 | Example 5 | Example 6 | Example 7 | Example 8 | Example 9 | Example 10 | Example 11 |
|---|---|---|---|---|---|---|---|---|---|---|---|
| Silica A | 20 | 30 | 40 | 0 | 0 | 0 | 0 | 0 | 0 | 0 | 0 |
| Silica B | 0 | 0 | 0 | 20 | 20 | 20 | 20 | 20 | 20 | 20 | 20 |
| Precipitated calcium carbonate | 0 | 0 | 0 | 0 | 0 | 0 | 0 | 0 | 0 | 0 | 0 |
| Carboxymethyl cellulose | 80 | 70 | 60 | 80 | 80 | 80 | 80 | 80 | 80 | 80 | 80 |
| Phosphate esterified starch | 0 | 0 | 0 | 0 | 0 | 0 | 0 | 0 | 0 | 0 | 0 |
| Sodium polyacrylate | 0 | 0 | 0 | 0 | 0 | 0 | 0.2 | 0 | 0 | 0 | 0 |
| Ammonium polyacrylate | 0.2 | 0.2 | 0.2 | 0.2 | 0.1 | 0.4 | 0 | 0.2 | 0.2 | 0.2 | 0.05 |
| Polyacrylamide | 0 | 0 | 0 | 0 | 0 | 0 | 0 | 0 | 0 | 0 | 0 |
| Acetylene glycol derivative A | 0 | 0 | 0 | 0 | 0 | 0 | 0 | 0 | 0 | 0.2 | 0.2 |
| Acetylene glycol derivative B | 0.2 | 0.2 | 0.2 | 0.2 | 0.2 | 0.2 | 0.2 | 0.1 | 0.5 | 0 | 0 |
| Acetylene alcohol | 0 | 0 | 0 | 0 | 0 | 0 | 0 | 0 | 0 | 0 | 0 |
| Coated amount (g/m$^2$) | 2.5 | 2.5 | 2.5 | 2.5 | 2.5 | 2.5 | 2.5 | 2.5 | 2.5 | 2.5 | 2.5 |
| Mass ratio of polyacrylic acid salt content | 0.25 | 0.29 | 0.33 | 0.25 | 0.13 | 0.50 | 0.25 | 0.25 | 0.25 | 0.25 | 0.06 |
| Image deterioration resistance | B | B | A | B | B | B | C | B | C | B | B |
| Color development property | B | B | B | B | B | B | B | B | B | B | B |
| Adhesion property | A | A | B | A | A | A | A | B | A | A | B |

| Materials | Example 12 | Example 13 | Example 14 | Example 15 | Example 16 | Example 17 | Example 18 | Example 19 | Example 20 | Example 21 | Example 22 | Example 23 |
|---|---|---|---|---|---|---|---|---|---|---|---|---|
| Silica A | 0 | 0 | 0 | 0 | 0 | 0 | 0 | 0 | 0 | 0 | 0 | 0 |
| Silica B | 0 | 0 | 0 | 0 | 0 | 0 | 0 | 0 | 0 | 0 | 0 | 0 |
| Precipitated calcium carbonate | 50 | 60 | 70 | 70 | 70 | 70 | 70 | 70 | 70 | 70 | 80 | 70 |
| Carboxymethyl cellulose | 50 | 40 | 30 | 30 | 30 | 30 | 30 | 30 | 10 | 20 | 20 | 30 |
| Phosphate esterified starch | 0 | 0 | 0 | 0 | 0 | 0 | 0 | 0 | 20 | 10 | 0 | 0 |
| Sodium polyacrylate | 0 | 0 | 0 | 0 | 0 | 0.7 | 0 | 0 | 0 | 0 | 0 | 0 |
| Ammonium polyacrylate | 0.7 | 0.7 | 0.7 | 0.5 | 1.0 | 0 | 0.7 | 0.7 | 0.7 | 0.7 | 0.7 | 1.2 |
| Polyacrylamide | 0 | 0 | 0 | 0 | 0 | 0 | 0 | 0 | 0 | 0 | 0 | 0 |
| Acetylene glycol derivative A | 0 | 0 | 0 | 0 | 0 | 0 | 0 | 0.2 | 0 | 0 | 0 | 0 |
| Acetylene glycol derivative B | 0.2 | 0.2 | 0.2 | 0.2 | 0.2 | 0.2 | 0.5 | 0 | 0.2 | 0.2 | 0.2 | 0.2 |
| Acetylene alcohol | 0 | 0 | 0 | 0 | 0 | 0 | 0 | 0 | 0 | 0 | 0 | 0 |

TABLE 1-continued

| | | | | | | | | | | | | |
|---|---|---|---|---|---|---|---|---|---|---|---|---|
| Coated amount ($g/m^2$) | 10 | 10 | 10 | 10 | 10 | 10 | 10 | 10 | 10 | 10 | 10 | 10 |
| Mass ratio of polyacrylic acid salt content | 1.40 | 1.75 | 2.33 | 1.67 | 3.33 | 2.33 | 2.33 | 2.33 | 2.33 | 2.33 | 3.50 | 4.00 |
| Image deterioration resistance | B | B | A | A | B | C | C | A | A | A | A | B |
| Color development property | A | A | A | A | A | B | B | A | A | A | A | B |
| Adhesion property | A | A | B | B | B | B | A | B | B | B | B | B |

| Materials | Example 24 | Example 25 | Com. Ex. 1 | Com. Ex. 2 | Com. Ex. 3 | Com. Ex. 4 | Com. Ex. 5 | Com. Ex. 6 | Com. Ex. 7 | Com. Ex. 8 | Com. Ex. 9 | Com. Ex. 10 |
|---|---|---|---|---|---|---|---|---|---|---|---|---|
| Silica A | 0 | 0 | 0 | 0 | 0 | 0 | 0 | 0 | 0 | 0 | 0 | 0 |
| Silica B | 20 | 0 | 20 | 20 | 20 | 20 | 0 | 0 | 0 | 0 | 0 | 0 |
| Precipitated calcium carbonate | 0 | 70 | 0 | 0 | 0 | 0 | 0 | 70 | 70 | 70 | 70 | 0 |
| Carboxymethyl cellulose | 80 | 30 | 80 | 80 | 80 | 80 | 80 | 30 | 30 | 30 | 30 | 30 |
| Phosphate esterified starch | 0 | 0 | 0 | 0 | 0 | 0 | 20 | 0 | 0 | 0 | 0 | 70 |
| Sodium polyacrylate | 0 | 0 | 0 | 0 | 0 | 0 | 0 | 0 | 0 | 0 | 0 | 0 |
| Ammonium polyacrylate | 0.2 | 0.7 | 0 | 0.2 | 0.2 | 0 | 0.2 | 0 | 0.7 | 0.7 | 0 | 0.7 |
| Polyacrylamide | 0 | 0 | 0 | 0 | 0 | 0.2 | 0 | 0 | 0 | 0 | 0.7 | 0 |
| Acetylene glycol derivative A | 0 | 0 | 0 | 0 | 0 | 0 | 0 | 0 | 0 | 0 | 0 | 0 |
| Acetylene glycol derivative B | 0.2 | 0.2 | 0.2 | 0 | 0 | 0.2 | 0.2 | 0.2 | 0 | 0 | 0.2 | 0.2 |
| Acetylene alcohol | 0 | 0 | 0 | 0 | 0.2 | 0 | 0 | 0 | 0 | 0.2 | 0 | 0 |
| Coated amount ($g/m^2$) | 2.5 | 2.5 | 2.5 | 2.5 | 2.5 | 2.5 | 2.5 | 10 | 10 | 10 | 10 | 10 |
| Mass ratio of polyacrylic acid salt content | 0.25 | 2.33 | 0.00 | 0.25 | 0.25 | 0.00 | 0.20 | 0.00 | 2.33 | 2.33 | 0.00 | 0.70 |
| Image deterioration resistance | B | A | B | B | B | C | D | A | A | A | A | D |
| Color development property | B | A | C | B | B | C | A | C | A | A | C | A |
| Adhesion property | A | B | B | C | C | B | D | B | C | C | B | D |

"Mass ratio of polyacrylic acid salt content" in Table 1 is the content of the polyacrylic acid salt based on 100 parts by mass of the binder in the outermost coating layer.

<Preparation of Printed Transfer Paper>

Evaluation patterns with sublimation dye inks (cyan, magenta, yellow) were printed on each transfer paper obtained using an inkjet printer (JV 2-130 II, manufactured by Mimaki Engineering Co., Ltd.) using sublimation textile ink to obtain each printed transfer paper.

<Textile Printing (Cut Paper)>

A polyester fabric was used as a printing substrate. The resultant printed transfer paper and the polyester fabric were brought into close contact with each other and heated at 200° C. for 1 minute using a thermal transfer press (manual wide swinger Model 221, manufactured by Insta Graphic Systems) to transfer the dye to the polyester fabric, and then the printed transfer paper was peeled off from the polyester fabric to obtain a polyester fabric having a pattern formed thereon.

<Evaluation of Image Deterioration Resistance>

From the viewpoint of the sharpness of the pattern, the image deterioration resistance of the polyester fabric having the pattern formed thereon was visually evaluated according to the following criteria. In the present invention, if the evaluation is A, B or C, the transfer paper is judged to have image deterioration resistance.

A: Good level.

B: Deterioration of image quality is hardly recognized and it is generally good level.

C: Deterioration of image quality is recognized, but it is practically problem free level.

D: Level at which deterioration of image which becomes practically unusable is recognized.

<Evaluation of Color Development Property>

In the textile printed printing substrate, the color density of the solid image portion of three sublimation textile inks (cyan, magenta, yellow) was measured with an optical densitometer (X-rite 530, manufactured by SAKATA JINX ENG. CO., LTD.), and color density values of three colors were added up. Color development property was judged according to the following criteria. In the present invention, if the evaluation is A or B, the transfer paper is judged to have good color development property.

A: Total value is 4.7 or more

B: Total value is 4.4 or more and less than 4.7

C: Total value is less than 4.4

<Textile Printing (Roll Paper)>

Polyester fabric of scroll was used as a printing substrate. The resultant roll paper-state printed transfer paper and the polyester fabric were brought into close contact with each other, and the dye was transferred to the polyester fabric using a heating and pressing machine (200° C., 0.5 MPa, 2.5 m/min, roller type, contact time with rollers for 30 seconds). Thereafter, the printed transfer paper was peeled off from the polyester fabric to obtain a polyester fabric having a pattern formed thereon.

<Evaluation of Adhesion Property>

From the viewpoint of the degree of occurrence of out-of-focus and distortion of the pattern, the polyester fabric having the pattern formed thereon was visually evaluated on adhesion property according to the following criteria. In the present invention, if the evaluation is A or B, the transfer paper is judged to have excellent adhesion property.

A: Out-of-focus and distortion are not observed, and it is good level.

B: Out-of-focus and distortion are scarcely observed, and it is generally good level.

C: Out-of-focus and distortion are observed, but it is practically problem free level. D: Out-of-focus and distortion are observed, and it is a problematic level in practical use.

The evaluation results are shown in Table 1.

From the evaluation results in Table 1, it is understood that Examples 1 to 25, each of which corresponds to a transfer paper in which the outermost coating layer contains a pigment, a binder, a polyacrylic acid and an acetylene glycol derivative, have image deterioration resistance, color development property and adhesion property. However, it is understood that Comparative Examples 1 to 10, each of which does not correspond to the above transfer paper, cannot satisfy any of image deterioration resistance, color development property or adhesion property.

From the comparison between mainly Examples 4 to 6 and 14 to 16 and mainly Examples 11 and 23, it is understood that, in the outermost coating layer, the content of the polyacrylic acid salt is preferably in the range of 0.1 part by mass or more and 3.5 parts by mass or less based on 100 parts by mass of the binder.

From the comparison between mainly Examples 4 and 14 and mainly Examples 7 and 17, it is understood that polyacrylic acid salt is preferably ammonium polyacrylate.

It is understood that the weight average molecular weight of ammonium polyacrylate as measured by gel permeation chromatography is preferably 5,000 or more and 30,000 or less from Examples 1 to 23 in which that weight average molecular weight is about 22,000 and Examples 24 and 25 in which it is about 6,000.

Next, the following outermost coating layer-coating composition was prepared.

<Outermost Coating Layer-Coating Composition>

The outermost coating layer-coating composition was prepared by mixing and dispersing in water using the materials shown in Table 2.

The amount of each material contained in the outermost coating layer-coating composition is also shown in Table 2.

TABLE 2

| Materials | Example 26 | Example 27 | Example 28 | Example 29 | Example 30 | Example 31 | Example 32 | Example 33 | Example 34 | Example 35 | Example 36 |
|---|---|---|---|---|---|---|---|---|---|---|---|
| Precipitated calcium carbonate | 50 | 50 | 50 | 60 | 70 | 80 | 50 | 50 | 80 | 80 | 80 |
| Kaolin | 0 | 0 | 0 | 0 | 0 | 0 | 0 | 0 | 0 | 0 | 0 |
| Silica | 0 | 0 | 0 | 0 | 0 | 0 | 0 | 0 | 0 | 0 | 0 |
| Carboxymethyl cellulose | 50 | 50 | 50 | 40 | 30 | 20 | 50 | 50 | 20 | 20 | 20 |
| Sodium polyacrylate | 0 | 0 | 0 | 0 | 0 | 0 | 0 | 0 | 0 | 0 | 0 |
| Ammonium polyacrylate | 0.1 | 0.5 | 0.7 | 0.7 | 0.7 | 0.7 | 0.7 | 0.7 | 0.5 | 0.5 | 0.1 |
| Acetylene glycol derivative A | 0 | 0 | 0 | 0 | 0 | 0 | 0 | 0 | 0 | 0 | 0 |
| Acetylene glycol derivative B | 0.2 | 0.2 | 0.2 | 0.2 | 0.2 | 0.2 | 0.2 | 0.2 | 0.2 | 0.2 | 0.2 |
| Acetylene alcohol | 0 | 0 | 0 | 0 | 0 | 0 | 0 | 0 | 0 | 0 | 0 |
| Coated amount (g/m$^2$) | 10 | 10 | 10 | 10 | 10 | 10 | 18 | 18 | 5 | 5 | 5 |
| Air permeability (ml/min) | 106 | 101 | 98 | 145 | 206 | 230 | 65 | 51 | 273 | 290 | 325 |
| Strike-through suppression property | A | A | A | A | A | A | A | A | A | A | B |
| Ink absorption property | B | B | B | A | A | A | B | B | B | B | B |
| Image deterioration resistance | A | A | A | A | A | A | A | A | A | A | A |
| Fog resistance | A | A | B | A | A | A | B | B | A | A | A |

| Materials | Example 37 | Example 38 | Example 39 | Example 40 | Example 41 | Example 42 | Example 43 | Example 44 | Example 45 | Example 46 | Example 47 | Example 48 |
|---|---|---|---|---|---|---|---|---|---|---|---|---|
| Precipitated calcium carbonate | 70 | 70 | 70 | 70 | 70 | 70 | 70 | 70 | 60 | 56 | 56 | 70 |
| Kaolin | 0 | 0 | 0 | 0 | 0 | 0 | 0 | 0 | 10 | 14 | 0 | 0 |
| Silica | 0 | 0 | 0 | 0 | 0 | 0 | 0 | 0 | 0 | 0 | 14 | 0 |
| Carboxymethyl cellulose | 30 | 30 | 30 | 30 | 30 | 30 | 30 | 30 | 30 | 30 | 30 | 30 |
| Sodium polyacrylate | 0 | 0 | 0.7 | 0 | 0 | 0 | 0 | 0.7 | 0 | 0 | 0 | 0 |
| Ammonium polyacrylate | 0.7 | 0.7 | 0 | 0.7 | 0.7 | 0.7 | 0.7 | 0 | 0.7 | 0.7 | 0.7 | 0.7 |
| Acetylene glycol derivative A | 0 | 0 | 0 | 0 | 0 | 0 | 0 | 0 | 0 | 0 | 0 | 0.2 |
| Acetylene glycol derivative B | 0.2 | 0.2 | 0.2 | 0.2 | 0.2 | 0.2 | 0.2 | 0.2 | 0.2 | 0.2 | 0.2 | 0 |
| Acetylene alcohol | 0 | 0 | 0 | 0 | 0 | 0 | 0 | 0 | 0 | 0 | 0 | 0 |
| Coated amount (g/m$^2$) | 10 | 10 | 10 | 10 | 10 | 10 | 10 | 10 | 10 | 10 | 10 | 10 |
| Air permeability (ml/min) | 189 | 171 | 173 | 181 | 182 | 174 | 186 | 187 | 157 | 136 | 245 | 202 |
| Strike-through suppression property | A | A | A | A | A | B | A | A | A | B | B | A |
| Ink absorption property | B | B | B | B | B | B | A | A | A | B | B | A |
| Image deterioration resistance | A | A | B | A | A | A | A | B | A | A | A | A |
| Fog resistance | B | B | B | B | B | A | A | A | A | B | B | A |

The materials used and shown in Table 2 are shown below.

Precipitated Calcium Carbonate of Examples 26 to 36

Callite® SA manufactured by SHIRAISHI CALCIUM KAISHA, LTD.

Aragonite Type Crystal

Average long diameter/average short diameter=6.5

Average secondary particle diameter=3.3 μm, burr-shape

Calcium Carbonate of Example 37

TamaPearl TP-121SA manufactured by OKUTAMA KOGYO CO., LTD.

Calcite type crystal

Average long diameter/average short diameter=4.0

Average secondary particle diameter=3.5 burr-shape

Precipitated Calcium Carbonate of Examples 38 and 39

TamaPearl TP-221BM manufactured by OKUTAMA KOGYO CO., LTD.
Calcite type crystal
Average long diameter/average short diameter=3.0
Average secondary particle diameter=4.0 μm, burr-shape Precipitated Calcium Carbonate of Example 40

TamaPearl TP-121S manufactured by OKUTAMA KOGYO CO., LTD.
Calcite type crystal
Average long diameter/average short diameter=4.0
Average secondary particle diameter=4.3 μm, burr-shape Precipitated Calcium Carbonate of Example 41

TamaPearl TP-121MS manufactured by OKUTAMA KOGYO CO., LTD.
Calcite type crystal
Average long diameter/average short diameter=3.0
Average secondary particle diameter=2.3 μm, burr-shape Precipitated Calcium Carbonate of Example 42

Tunex® E manufactured by SHIRAISHI CALCIUM KAISHA, LTD.
Calcite type crystal
Average long diameter/average short diameter=3.0
Average secondary particle diameter=5.6 μm, burr-shape Precipitated Calcium Carbonate of Examples 43 and 44

Callite KT manufactured by SHIRAISHI CALCIUM KAISHA, LTD.
Aragonite type crystal
Average long diameter/average short diameter=6.7
Average secondary particle diameter=2.6 μm, burr-shape Precipitated Calcium Carbonate of Examples 45 and 46

Callite SA manufactured by SHIRAISHI CALCIUM KAISHA, LTD.
Aragonite type crystal
Average long diameter/average short diameter=6.5
Average secondary particle diameter=3.3 μm, burr-shape Kaolin of Examples 45 and 46

HG 90 manufactured by J.M. Huber Corporation
Average particle diameter=0.19 μm

Precipitated Calcium Carbonate of Example 47

Callite SA manufactured by SHIRAISHI CALCIUM KAISHA, LTD.
Aragonite type crystal
Average long diameter/average short diameter=6.5
Average secondary particle diameter=3.3 μm, burr-shape Silica of Example 47

Finesil® X-37 manufactured by Oriental Silicas Corporation
Average particle diameter=2.6 μm Precipitated calcium carbonate of Example 48

Callite® SA manufactured by SHIRAISHI CALCIUM KAISHA, LTD.
Aragonite type crystal
Average long diameter/average short diameter=6.5
Average secondary particle diameter=3.3 μm, burr-shape <Transfer Paper>

A transfer paper was prepared by the following procedure.

On the base paper, the outermost coating layer-coating composition was coated on one side with an air knife coater, and dried in a hot air dryer. After that, it was subjected to calendering processing to obtain a transfer paper. The air permeability of the transfer paper was adjusted according to the coating amount and/or the calendering processing conditions. The coated amount was shown in Table 2.

<Preparation of Printed Transfer Paper>

Evaluation patterns with sublimation textile inks (cyan, magenta, yellow, black) were printed on each transfer paper obtained using an inkjet printer (JV2-130 II, manufactured by Mimaki Engineering Co., Ltd.) using sublimation textile ink to obtain each printed transfer paper (roll paper).

<Evaluation of Strike-Through Suppression Property>

From the degree of the image visibility from the back side of the printed transfer paper, the printed transfer paper obtained as described above was visually evaluated for strike-through suppression property according to the following criteria. In the present invention, if the evaluation is A or B, the transfer paper is judged to have strike-through suppression property.

A: Strike-through is almost not observed, and it is a good level.

B: Although strike-through is slightly observed, it is a practically acceptable level for subsequent transfer.

C: Strike-through is observed and it is a problematic level in practical use for subsequent transfer.

<Evaluation of Ink Absorption Property>

After leaving the printed transfer paper obtained as described above at 23±1° C. and 50±2% RH for 5 hours, each color outline portion and knocked out portion were evaluated according to the following criteria for the printed matter near the roll core of the roll paper. In the present invention, if the evaluation is A or B, the transfer paper is judged to have ink absorption property.

A: Bleeding is not observed in each color outline portion and knocked out portion by microscopic observation (×25).

B: Slight bleeding is observed in each color outline portion and knocked out portion by microscopic observation (×25). Such slight bleeding is hardly observed by visual observation, and there is no problem in practical use.

C: Bleeding is observed in each color outline portion and knocked out portion by microscopic observation (×25). Such bleeding is recognized slightly by visual observation, which is a problem in practical use.

D: Bleeding is observed in each color outline portion and knocked out portion by visual observation.

<Textile Printing (Roll Paper)>

Polyester fabric of scroll was used as a printing substrate. The resultant roll paper-state printed transfer paper and the polyester fabric were brought into close contact with each other, and the dye was transferred to the polyester fabric using a heating and pressing machine (200° C., 0.5 MPa, 2.5 m/min, roller type, contact time with rollers for 30 seconds).

Thereafter, the printed transfer paper was peeled off from the polyester fabric to obtain a polyester fabric having a pattern formed thereon.

<Evaluation of Image Deterioration Resistance>

From the viewpoint of the sharpness of the pattern, the image deterioration resistance of the polyester fabric having the pattern formed thereon was visually evaluated according to the following criteria. In the present invention, if the evaluation is A, B or C, the transfer paper is judged to have image deterioration resistance.

A: Good level.

B: Deterioration of image quality is hardly recognized and it is generally good level.

C: Deterioration of image quality is recognized, but it is practically problem free level.

D: Level at which deterioration of image which becomes practically impossible is recognized.

<Evaluation of Fog Resistance>

With respect to the fog resistance, the presence or absence of spot stain on the printing substrate was observed with a magnifying glass and visually, and visually evaluated according to the following criteria. In the present invention, if the evaluation is A or B, the transfer paper is judged to have good fog resistance.

A: With a magnifying glass, no spot stains were observed, and it is good level.

B: By visual observation, spot stains were not observed and it is roughly good level.

C: By visual observation, spot stains which do not cause trouble is found but it is practically acceptable level.

D: By visual observation, spot stains that become defective are recognized, and it is practically unusable level.

The evaluation results are shown in Table 2 above.

From the evaluation results in Table 2, it is understood that Examples 26 to 48, each of which corresponds to the transfer paper wherein at least one of the pigment in the outermost coating layer is precipitated calcium carbonate having an average secondary particle diameter of 2 μm or more and 6 μm or less in which primary particles having an average long diameter/average short diameter ratio of 2.0 or more and 7.0 or less are radially aggregated at one end in the long diameter direction, and a content of the precipitated calcium carbonate is 80 parts by mass or more based on 100 parts by mass of the pigment in the outermost coating layer, have image deterioration resistance, fog resistance, strike-through suppression property and ink absorption property.

Mainly from the comparison between Examples 26, 27, 29 to 31, 34, 35 and 48 and Examples 28, 32, 33 and 36, the transfer paper preferably has an air permeability of more than 100 ml/min and 320 ml/min or less.

INDUSTRIAL APPLICABILITY

The transfer paper according to the present invention is a useful transfer paper satisfying all of the following items.

(1) Deterioration of an image in a printing substrate can be suppressed (image deterioration resistance).

(2) Reduction of color development in a printing substrate can be suppressed (color development property)

(3) A printed transfer paper and a printing substrate are well adhered (adhesion property)

(4) Fog can be suppressed from occurring in a printing substrate (fog resistance)

(5) Strike-through can be suppressed in a printed transfer paper (strike-through suppression property)

(6) Ink can be absorbed so as not to bleed in a printed transfer paper (ink absorption property)

The invention claimed is:

1. A transfer paper used for a transfer printing method using sublimation textile ink, comprising a base paper and one or more coating layer(s) provided on at least one side of the base paper, wherein an outermost coating layer positioned on the outermost side with respect to the base paper contains at least a pigment, a binder, a polyacrylic acid salt and an acetylene glycol derivative, wherein the polyacrylic acid salt is ammonium polyacrylate.

2. The transfer paper according to claim 1, wherein, in the outermost coating layer, a content of the polyacrylic acid salt is 0.1 parts by mass or more and 3.5 parts by mass or less based on 100 parts by mass of the binder.

3. The transfer paper according to claim 1, wherein a weight average molecular weight of the ammonium polyacrylate measured by gel permeation chromatography method is 5,000 or more and 30,000 or less.

4. The transfer paper according to claim 1, wherein at least one of the pigment in the outermost coating layer is precipitated calcium carbonate having an average secondary particle diameter of 2 μm or more and 6 μm or less in which primary particles having an average long diameter/average short diameter ratio of 2.0 or more and 7.0 or less are radially aggregated at one end in the long diameter direction, and a content of the precipitated calcium carbonate is 80 parts by mass or more based on 100 parts by mass of the pigment in the outermost coating layer.

5. The transfer paper according to claim 4, wherein an air permeability obtained by measuring the side provided with the outermost coating layer according to ISO 5636-3 is more than 100 ml/min and 320 ml/min or less.

6. The transfer paper according to claim 2, wherein a weight average molecular weight of the ammonium polyacrylate measured by gel permeation chromatography method is 5,000 or more and 30,000 or less.

7. The transfer paper according to claim 2, wherein at least one of the pigment in the outermost coating layer is precipitated calcium carbonate having an average secondary particle diameter of 2 μm or more and 6 μm or less in which primary particles having an average long diameter/average short diameter ratio of 2.0 or more and 7.0 or less are radially aggregated at one end in the long diameter direction, and a content of the precipitated calcium carbonate is 80 parts by mass or more based on 100 parts by mass of the pigment in the outermost coating layer.

8. The transfer paper according to claim 7, wherein an air permeability obtained by measuring the side provided with the outermost coating layer according to ISO 5636-3 is more than 100 ml/min and 320 ml/min or less.

9. The transfer paper according to claim 3, wherein at least one of the pigment in the outermost coating layer is precipitated calcium carbonate having an average secondary particle diameter of 2 μm or more and 6 μm or less in which primary particles having an average long diameter/average short diameter ratio of 2.0 or more and 7.0 or less are radially aggregated at one end in the long diameter direction, and a content of the precipitated calcium carbonate is 80 parts by mass or more based on 100 parts by mass of the pigment in the outermost coating layer.

10. The transfer paper according to claim 9, wherein an air permeability obtained by measuring the side provided with the outermost coating layer according to ISO 5636-3 is more than 100 ml/min and 320 ml/min or less.

11. The transfer paper according to claim 6, wherein at least one of the pigment in the outermost coating layer is precipitated calcium carbonate having an average secondary particle diameter of 2 μm or more and 6 μm or less in which primary particles having an average long diameter/average short diameter ratio of 2.0 or more and 7.0 or less are radially aggregated at one end in the long diameter direction, and a content of the precipitated calcium carbonate is 80 parts by mass or more based on 100 parts by mass of the pigment in the outermost coating layer.

12. The transfer paper according to claim 11, wherein an air permeability obtained by measuring the side provided with the outermost coating layer according to ISO 5636-3 is more than 100 ml/min and 320 ml/min or less.

* * * * *